US005394714A

United States Patent [19]

Trusty

[11] Patent Number: 5,394,714

[45] Date of Patent: Mar. 7, 1995

[54] CONCEALED LOCKING APPARATUS FOR A MOTOR VEHICLE TRUNK

[76] Inventor: James D. Trusty, 2114-40th Ave., Longview, Wash. 98632

[21] Appl. No.: 116,855

[22] Filed: Sep. 7, 1993

[51] Int. Cl.[6] ..... E05B 65/19

[52] U.S. Cl. ..... 70/159; 70/240; 292/DIG. 42; 292/289

[58] Field of Search ..... 70/14, 93, 158–169, 70/237, 238, 240, 252, DIG. 57, DIG. 64, DIG. 65; 292/216, 259, 262, 289, DIG. 14, DIG. 42, DIG. 43

[56] References Cited

U.S. PATENT DOCUMENTS

| | | | |
|---|---|---|---|
| 1,348,090 | 7/1920 | Cooper | 70/240 X |
| 1,580,907 | 4/1926 | Ladwig et al. | 70/240 |
| 2,727,774 | 12/1955 | Marple et al. | 292/216 |
| 3,115,764 | 12/1963 | Kraver | 70/240 |
| 3,273,935 | 9/1966 | Carson | 292/288 X |
| 3,597,947 | 8/1971 | Solow | 70/240 |
| 3,600,026 | 8/1971 | Savio | 70/93 X |
| 3,660,997 | 5/1972 | Michnoff | 70/240 |
| 3,668,908 | 6/1972 | Levy | 70/240 |
| 4,126,330 | 11/1978 | Poole | 70/237 |
| 4,666,194 | 5/1987 | Charman | 292/288 |
| 4,819,461 | 4/1989 | Pearson | 70/14 |
| 4,998,425 | 3/1991 | Hoogland | 70/159 |
| 5,165,743 | 11/1992 | Zock | 292/DIG. 43 X |

*Primary Examiner*—Peter M. Cuomo
*Assistant Examiner*—Suzanne L. Dino
*Attorney, Agent, or Firm*—Rhodes and Ascolillo

[57] ABSTRACT

A locking apparatus for securing a cargo compartment of a motor vehicle, the cargo compartment including a cargo compartment lid that moves away from the body of the motor vehicle to allow access to the interior of the cargo compartment, the cargo compartment lid having an interior surface within the cargo compartment, and the motor vehicle body having an interior surface within the interior of the cargo compartment, the locking apparatus including a first plate member for attachment to the interior surface of the cargo compartment lid, a first loop member, a mechanism for fixedly attaching the first loop member to the first plate member in at least two orientations, the at least two orientations being transverse with respect to one another, a second plate member for attachment to the interior surface of the motor vehicle body, a second loop member, and a mechanism for fixedly attaching the second loop member to the second plate member in at least two orientations, the at least two orientations being transverse with respect to one another.

3 Claims, 2 Drawing Sheets

CONCEALED LOCKING APPARATUS FOR A MOTOR VEHICLE TRUNK

BACKGROUND

1. Field of the Invention

The present invention relates to the field of anti-theft devices, more particularly locking arrangements for the trunk or cargo compartments of motor vehicles.

2. Description of the Related Art

U.S. Pat. No. 4,819,461 relates to a locking device for securing the rear door and tailgate of a truck equipped with a canopy and includes an elongated member having a loop at the upper end for securing the handle of the truck canopy and a lower end that extends through the bumper of the truck.

U.S. Pat. No. 4,126,330 relates to an anti-theft device for a tractor trailer rig that includes a pair of housings affixed to the side surfaces of the trailer and a pair of elongated locking bars slidably mounted in the housings and anchored therein, the ends of the locking bars being securable by a pair of padlocks to the rear of the tractor.

U.S. Pat. No. 3,668,908 relates to an automobile hood locking device that includes an arm fastened to the hood that projects through a plate which is fastened to the automobile body, the arm being secured by a padlock.

U.S. Pat. No. 3,660,997 relates to a chain lock for securing the engine compartment of an automobile, wherein one end of a chain is attached to the automobile hood and the other end of the chain is detachable engaged with a key operated locking mechanism that is attached to a portion of the engine compartment.

U.S. Pat. No. 2,727,774 relates to a latch mechanism for the deck lid of an automobile which has a pivotal handle and key operated lock on a shaft that extends through the deck lid.

SUMMARY OF THE INVENTION

Most cargo compartments (or "trunks") of automobiles are provided with a locking latch mechanism as original equipment. However, such locking latch mechanisms can be relatively easily defeated (or "jimmied") by a thief and access gained to what may often be valuable possessions.

Additionally, while many automobiles are currently being equipped with alarms, an experienced thief can often easily break into an automobile trunk and escape with any valuable contents before the owner is able to respond to the activated alarm.

Accordingly, one object of the present invention is the provision of a locking device for the cargo compartment (or trunk) of a motor vehicle that is not easily or quickly defeated.

Another object of the invention is the provision of such a locking device that can be used in combination with the original equipment locking latch mechanism commonly provided.

A further object of the invention is the provision of such a locking device that will discourage any further attempts to gain access to the automobile trunk.

A still further object of the invention is the provision of such a locking device that will be difficult to defeat and that will therefore provide additional time for responding to an activated automobile alarm.

In one aspect, the invention generally features a locking apparatus for the cargo compartment of a motor vehicle, the motor vehicle including a vehicle body and a cargo compartment lid opening away from the vehicle body to expose an interior of the cargo compartment, the locking apparatus including: a first loop structure secured to the compartment lid; the first loop structure being disposed within the interior of the cargo compartment; and a second loop structure secured to the vehicle body; the second loop structure being disposed within the interior of the cargo compartment.

Preferably, the vehicle body includes an interior vehicle body surface interior to the cargo compartment, the cargo compartment lid includes an interior lid surface interior to the cargo compartment, the first loop structure includes a first plate member attached to the vehicle body surface interior to the cargo compartment and a first loop member extending outward from the first plate member, and the second loop structure includes a second plate member attached to the interior lid surface and a second loop member extending outward from the second plate member; the locking apparatus additionally includes an adjustment mechanism for selectively fixedly attaching each of the first and second loop members to each of the first and second plate members, respectively, in at least two configurations: a first configuration wherein the first and second loop members extend outward from the respective first and second plate members along a first axis, and a second configuration wherein the first and second loop members extend outward from the respective first and second plate members along a second axis, the first and second axes being transverse with respect to one another; and the first and second axes are substantially orthogonal with respect to one another.

In another aspect, the invention generally features a locking apparatus for securing a cargo compartment of a motor vehicle, the cargo compartment including a cargo compartment lid that moves away from the body of the motor vehicle to allow access to the interior of the cargo compartment, the cargo compartment lid having an interior surface within the cargo compartment, and the motor vehicle body having an interior surface within the interior of the cargo compartment, the locking apparatus including: a first plate member for attachment to the interior surface of the cargo compartment lid; a first loop member; a mechanism for fixedly attaching the first loop member to the first plate member in at least two orientations, the at least two orientations being transverse with respect to one another; a second plate member for attachment to the interior surface of the motor vehicle body; a second loop member; and a mechanism for fixedly attaching the second loop member to the second plate member in at least two orientations, the at least two orientations being transverse with respect to one another.

Preferably, each of the mechanisms for fixedly attaching the first and second loop members to the first and second plate members, respectively, includes: a first pair of holes provided in each of the first and second plate members, the first pair of holes being spaced from one another along a first axis; a second pair of holes provided in each of the first and second plate members, the second pair of holes being spaced from one another along a second axis; the first and second axes being transverse with respect to one another; a U-shaped member having a pair of ends for selectively engaging either the first pair of holes or the second pair of holes; and a clamp seating member disposed between each of the first and second plate members and the respective U-shaped member, the clamp seating member abutting the respective U-shaped member; each of the loop members being clamped between one of the U-shaped members and one of the clamp seating members; the locking apparatus additionally includes a pair of apertures provided in each of the clamp seating members, the ends of the respective U-shaped member passing through the pair of apertures; and each of the pair of ends of the U-shaped members is threaded, and the locking apparatus additionally includes a bolt for threadingly engaging each of the threaded ends of each of the U-shaped members.

In yet another aspect, the invention generally features a locking apparatus for securing a cargo compartment of a motor vehicle, the cargo compartment including a cargo compartment lid that moves away from the body of the motor vehicle to allow access to the interior of the cargo compartment, the cargo compartment lid having an interior surface within the cargo compartment, and the motor vehicle body having an interior surface within the interior of the cargo compartment, the locking apparatus including: a first plate member for attachment to the interior surface of the cargo compartment lid; a first loop member; a mechanism for fixedly attaching the first loop member to the first plate member in at least two orientations, the at least two orientations being transverse with respect to one another; a second plate member for attachment to the interior surface of the motor vehicle body; a second loop member; and a mechanism for fixedly attaching the second loop member to the second plate member in at least two orientations, the at least two orientations being transverse with respect to one another; and a padlock for interlocking the first and second loop members; each of the mechanisms for attaching the first loop member and the second loop member including: a first pair of holes provided in the plate member along a first axis; a second pair of holes provided in the plate member along a second axis; the first and second axes being oriented substantially orthogonal with respect to one another; a U-shaped member having a pair of bifurcated ends for selectively engaging either the first pair of holes or the second pair of holes; and a clamp seating member disposed between the plate member and the U-shaped member; the clamp seating member having a pair of apertures for receiving the pair of bifurcated ends of the U-shaped member; and the loop member being clamped between the U-shaped member and the plate member.

The invention will now be described by way of a particularly preferred embodiment, reference being made to the accompanying drawings, wherein:

DESCRIPTION OF THE PREFERRED EMBODIMENT

Figure 1:
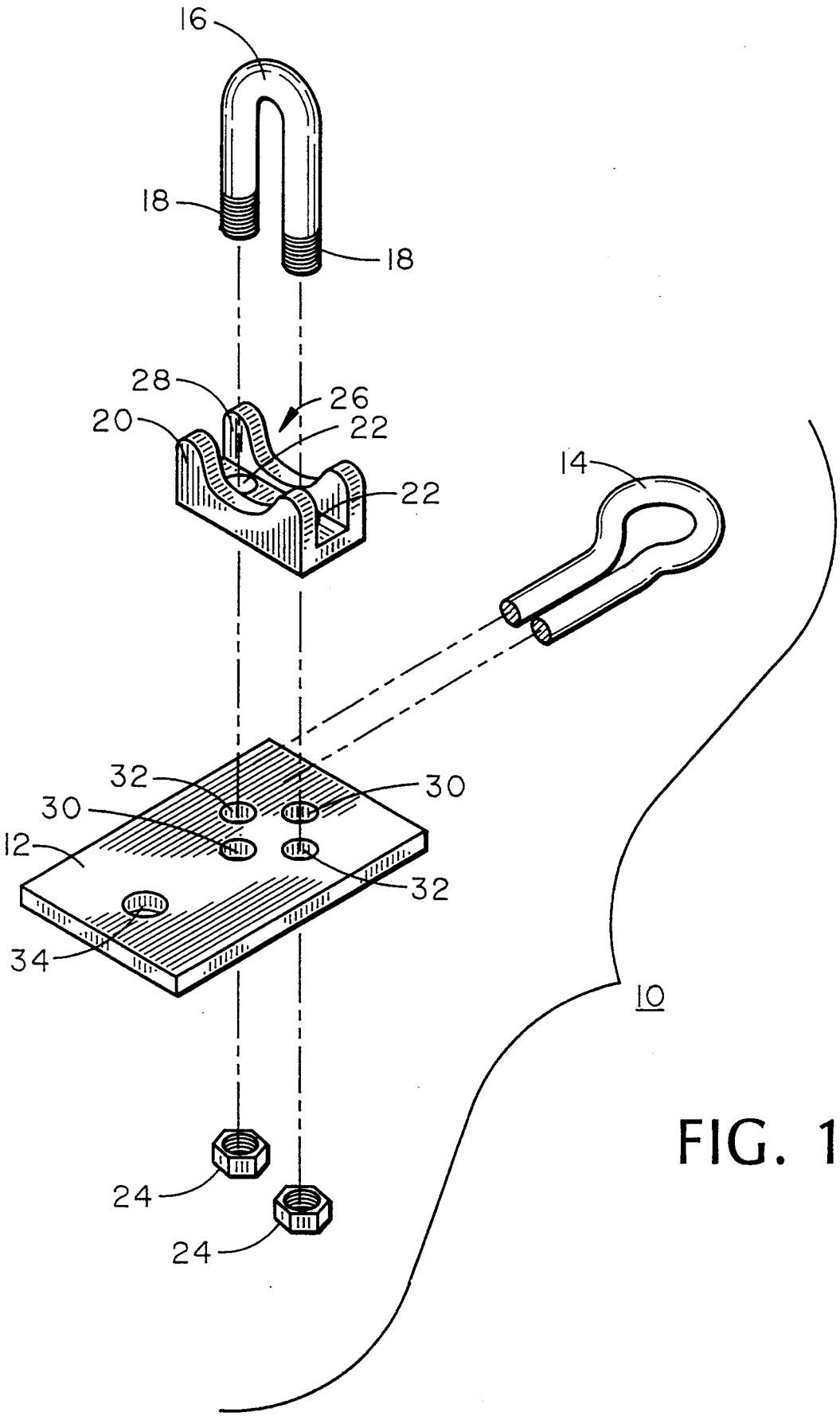
FIG. 1 is an exploded perspective view of one component of a locking apparatus for the trunk of a motor vehicle constructed according to the present invention, the locking apparatus including two such components.

Referring initially to FIG. 1, a locking apparatus for the cargo compartment of a motor vehicle constructed according to the present invention includes a pair of substantially identical loop structures 10, one of the two loop structures 10 being shown in FIG. 1. Each of the loop structures 10 generally includes a plate member 12, a loop member 14 that projects outward from the plate member 12, a U-shaped member 16 that partially surrounds the loop member 14 and which has a pair of bifurcated ends 18 that engage the plate member 12, and a clamp seat 20 that is positioned between a laterally extending central portion of the U-shaped member 16 and the plate member 12.

The clamp seat 20 is preferably provided with a pair of throughgoing apertures 22, through which the bifurcated ends 18 of the U-shaped member pass. Each bifurcated end 18 of the U-shaped member 16 is threaded and is drawn inward toward the plate member 12 by threaded bolts 24 located on the opposite side of the plate member 12 from the clamp seat 20. As shown, the clamp seat 20 preferably has an arcuate depression 26 formed in its upper surface between the apertures 22, and a furrow 28 extends the length of the clamp seat 20 along the axis of the apertures 22. This particular configuration provides a positive clamping action on the loop member 14, which is positioned and clamped between the central portion of the U-shaped member 16 and the clamp seat 20.

The plate member 12 is provided with two separate pairs of holes 30 and 32, the holes 30 lying along an axis that is transverse, and preferably substantially perpendicular, with respect to the axis along which the other pair of holes 32 are disposed. As discussed more fully below, this permits the loop member 14 to project outward from the plate member 12 in at least two directions, thereby allowing the locking apparatus to be adapted for a broad range of vehicles and conditions. An additional hole 34 is provided at the other end of the plate member 12 for attachment, via a self tapping screw or the like, of each of the loop structures 10 to the motor vehicle.

Figure 3:
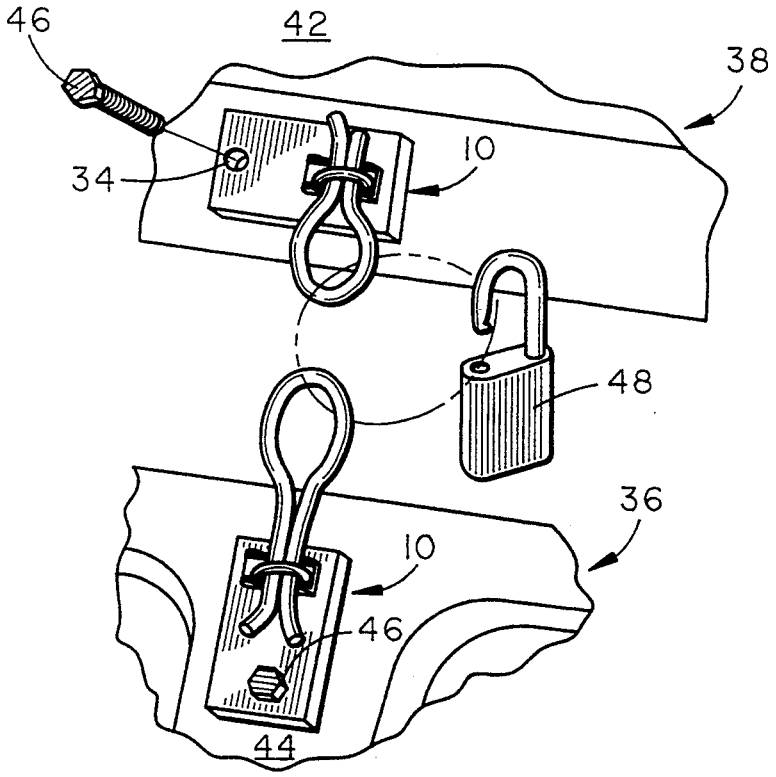
FIG. 3 is another perspective view of the locking apparatus installed on the trunk of a motor vehicle, wherein the locking apparatus is shown installed in a second alternative configuration.
Figure 2:
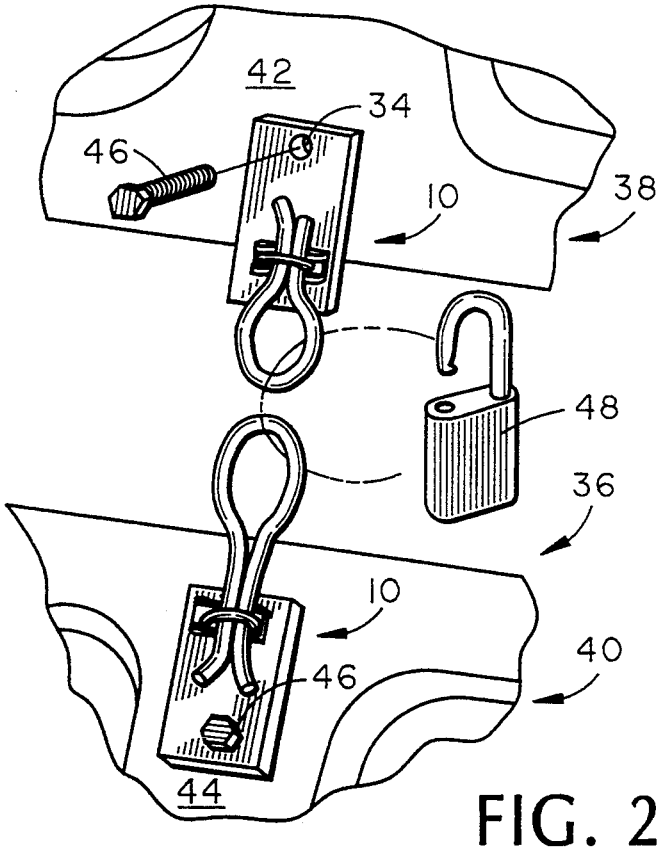
FIG. 2 is a perspective view of the locking apparatus of FIG. 1 installed on the trunk of a motor vehicle, the locking apparatus being installed in a first configuration.

FIG. 2 shows the inventive locking apparatus installed in the cargo compartment 36 (e.g., the trunk) of a motor vehicle, the cargo compartment 36 including a cargo compartment lid 38 that opens away from a body portion 40 of the motor vehicle. Each of the cargo compartment lid 38 and the body portion 40 has an interior surface 42 and 44, respectively, that are within the interior of (i.e., enclosed by) the cargo compartment 36, and one loop structure 10 is mounted on each of the interior surface 42 of the cargo compartment lid 38 and the interior surface 44 of the body portion 40. In FIG. 2, each of the loop structures 10 is shown mounted to the interior of the cargo compartment 36 in a configuration wherein both of the loop members 14 project outward, along the same axis, toward the opposing plate member 12. An alternative mounting configuration, wherein the loop members 14 are oriented at right angles to one another is shown in FIG. 3, this alternative mounting configuration being made possible by the provision of the two separate pairs of holes 30 and 32, as discussed above. Of course, it is also possible, although not specifically shown, for both of the loop structures 10 to be mounted such that both of the loop members 14 are disposed in a horizontal orientation. In any case, each of the loop structures 10 is attached to the respective interior surface of the cargo compartment 36, preferably by a self tapping screw 46 which passes through the provided hole 34 in the plate member 12.

Preferably, the loop members 14 are constructed from 3/16 inch steel cable that is sheathed in plastic, and the upper loop member is about 5 to 6 inches in length, while the lower loop member is about 4 inches in length. On most vehicles, these lengths permit easy access to the locking apparatus, while preventing removal of bulky objects such as suitcases and musical instrument cases from the cargo compartment 36. Additionally, the plate members 14 are preferably constructed of flat steel and have the approximate dimensions of $2\times1\frac{1}{4}\times\frac{1}{8}$ inches.

Finally, a key operated padlock 48 passes through and interlocks both of the loop members 14. With the inventive locking apparatus installed and locked via the padlock 48, an extra measure of security is provided against any theft of valuable possessions stored in the cargo compartment 36. While a thief may succeed in defeating the conventional locking latch mechanism found on most motor vehicle trunks, the cargo compartment lid 38 will only open to about 4 or 5 inches and will be restrained there by the inventive locking apparatus. At this point, an authorized user can reach in and unlock the padlock 48. A burglar will, however, be surprised and frustrated by the second obstruction. This can typically unavoidably delay the burglar and cause them to flee. Additionally, in the event that the motor vehicle is equipped with an alarm, the inventive locking apparatus will often delay any attempted burglary for a sufficient time to allow the owner to respond to an activated alarm signal.

While the invention has been herein described by way of a particular preferred embodiment, various substitutions of equivalents may be effected without departing from the spirit and scope of the invention as set forth in the following claims.

What is claimed is:

1. A locking apparatus for securing a cargo compartment of a motor vehicle, the cargo compartment including a cargo compartment lid that moves away from the body of the motor vehicle to allow access to the interior of the cargo compartment, the cargo compartment lid having an interior surface within the cargo compartment, and the motor vehicle body having an interior surface within the interior of the cargo compartment, said locking apparatus comprising:

a first plate member for attachment to the interior surface of the cargo compartment lid;

a first loop member;

means for fixedly attaching said first loop member to said first plate member in at least two orientations, said at least two orientations being transverse with respect to one another;

a second plate member for attachment to the interior surface of the motor vehicle body;

a second loop member; and means for fixedly attaching said second loop member to said second plate member in at least two orientations, said at least two orientations being transverse with respect to one another; and a padlock for interlocking said first and second loop members;

each of said means for attaching said first loop member and said second loop member comprising:

a first pair of holes provided in said plate member along a first axis;

a second pair of holes provided in said plate member along a second axis;

said first and second axes being oriented substantially orthogonal with respect to one another;

a U-shaped member having a pair of bifurcated ends for selectively engaging either said first pair of holes or said second pair of holes; and a clamp seating member disposed between said plate member and said U-shaped member;

said clamp seating member having a pair of apertures for receiving said pair of bifurcated ends of said U-shaped member; and said loop member being clamped between said U-shaped member and said plate member.

2. A locking apparatus for securing a cargo compartment of a motor vehicle, the cargo compartment including a cargo compartment lid that moves away from the body of the motor vehicle to allow access to the interior of the cargo compartment, the cargo compartment having an interior surface within the cargo compartment, and the motor vehicle body having an interior surface within the interior of the cargo compartment, said locking apparatus comprising:

(a) a first plate member for attachment to the interior surface of the cargo compartment lid;

(b) a second plate member for attachment to the interior surface of the motor vehicle body;

(c) first and second loop members;

(d) means for selectively attaching the first and second loop members to the first and second plate members in at least two orientations, the second orientation being substantially orthogonal to the first orientation, comprising:

(1) a first pair of holes spaced apart from one another, disposed along a longitudinal axis on each of the first and second plates;

(2) a second pair of holes spaced apart from one another, disposed on an axis of the first and said second plates that is substantially orthogonal and transverse to the longitudinal axis of the first pair of holes; and (3) means for selectively attaching the first and second loop members to the first and second plate members in at least two orientations, said means having at least one member selectively passing through the first and second pair of holes on the respective plate members; and (e) a padlock for interlocking the first and second loop members.

3. A locking apparatus for securing a cargo compartment of a motor vehicle, the cargo compartment including a cargo compartment lid that moves away from the body of the motor vehicle to allow access to the interior of the cargo compartment, the cargo compartment having an interior surface within the cargo compartment, the motor vehicle body having an interior surface within the interior of the cargo compartment, the locking apparatus including first and second plate members each having a pair of holes disposed along orthogonal and transverse axes, first and second loop members, and means of selectively attaching a respective loop member to a respective plate member comprising:

(a) a U-shaped member having a pair of threaded ends for selectively engaging either the first or second pair of holes in each first and second plate member;

(b) a clamp seating member having a pair of apertures through which the threaded ends of the U-Shaped member may pass, the clamp seating member disposed between each first and second plate member and the respective U-Shaped member;

(c) the respective loop member being clamped between one of said U-Shaped members and one of the clamp seating members, the threaded ends of the U-shaped member then selectively passing through the first or second pair of holes in the respective plate member; and (d) a pair of threaded bolts for threadingly engaging the threaded ends of the U-shaped member.

* * * * *